US009666921B2

(12) United States Patent
Rogozine et al.

(10) Patent No.: US 9,666,921 B2
(45) Date of Patent: May 30, 2017

(54) DIELECTRIC WAVEGUIDE FILTER WITH CROSS-COUPLING RF SIGNAL TRANSMISSION STRUCTURE

(71) Applicants: Alexandre Rogozine, Rio Rancho, NM (US); Nam Phan, Rio Rancho, NM (US)

(72) Inventors: Alexandre Rogozine, Rio Rancho, NM (US); Nam Phan, Rio Rancho, NM (US)

(73) Assignee: CTS Corporation, Lisle, IL (US)

( * ) Notice: Subject to any disclaimer, the term of this patent is extended or adjusted under 35 U.S.C. 154(b) by 156 days.

(21) Appl. No.: 14/754,212

(22) Filed: Jun. 29, 2015

(65) Prior Publication Data

US 2016/0380322 A1 Dec. 29, 2016

(51) Int. Cl.

| | |
|---|---|
| ***H01P 1/20*** | (2006.01) |
| ***H01P 7/10*** | (2006.01) |
| ***H01P 7/06*** | (2006.01) |

(52) U.S. Cl.

CPC ..... *H01P 1/2002* (2013.01); *H01P 7/065* (2013.01); *H01P 7/10* (2013.01)

(58) Field of Classification Search

CPC ..... H01P 1/2002; H01P 7/10
USPC ..... 333/208–212, 219.1
See application file for complete search history.

(56) References Cited

U.S. PATENT DOCUMENTS

| | | | |
|---|---|---|---|
| 3,882,434 | A | 5/1975 | Levy |
| 3,955,161 | A | 5/1976 | MacTurk |
| 4,396,896 | A | 8/1983 | Williams |
| 4,431,977 | A | 2/1984 | Sokola et al. |
| 4,609,892 | A | 9/1986 | Higgins, Jr. |
| 4,692,726 | A | 9/1987 | Green et al. |
| 4,706,051 | A | 11/1987 | Dieleman et al. |

(Continued)

FOREIGN PATENT DOCUMENTS

| | | | |
|---|---|---|---|
| CN | 201898182 | U | 7/2011 |
| CN | 102361113 | A | 2/2012 |

(Continued)

OTHER PUBLICATIONS

Ruiz-Cruz J et al: "Rectangular Waveguide Elliptic Filters with Capacitive and Inductive Irises and Integrated Coaxial Excitation", 2005 IEEE MTT-S International Microwave Symposium, Piscataway, NJ, USA, IEEE, (Jun. 12, 2005) pp. 269-272, EP010844740, DOI: 10.1109/MWSYM.2005.1516577, ISBN: 978-0-7803-8846-8 p. 269; figures 1,3.

(Continued)

*Primary Examiner* — Stephen E Jones
*Assistant Examiner* — Rakesh Patel
(74) *Attorney, Agent, or Firm* — Daniel Deneufbourg

(57) ABSTRACT

A dielectric wave guide filter comprising a block of dielectric material defining a plurality of resonators separated by an interior layer of conductive material. A first direct path for the transmission of an RF signal is defined by the plurality of resonators. An external substrate is coupled to an exterior surface of the block of dielectric material and defines a pair of RF signal input/output transmission vias filled with a conductive material and an interior RF signal transmission line extending between and interconnecting the pair or RF signal input/output transmission vias and providing an indirect cross-coupling path for the RF signal between two of the resonators separated by the interior layer of conductive material.

15 Claims, 4 Drawing Sheets

(56) References Cited

U.S. PATENT DOCUMENTS

| | | | |
|---|---|---|---|
| 4,733,208 | A | 3/1988 | Ishikawa et al. |
| 4,742,562 | A | 5/1988 | Kommrusch |
| 4,800,348 | A | 1/1989 | Rosar et al. |
| 4,806,889 | A | 2/1989 | Nakano et al. |
| 4,837,535 | A | 6/1989 | Konishi et al. |
| 4,940,955 | A | 7/1990 | Higgins, Jr. |
| 4,963,844 | A | 10/1990 | Konishi et al. |
| 4,996,506 | A | 2/1991 | Ishikawa et al. |
| 5,004,992 | A | 4/1991 | Grieco et al. |
| 5,023,944 | A | 6/1991 | Bradley |
| 5,130,682 | A | 7/1992 | Agahi-Kesheh |
| 5,208,565 | A | 5/1993 | Sogo et al. |
| 5,243,309 | A | 9/1993 | L'Ecuyer |
| 5,285,570 | A | 2/1994 | Fulinara |
| 5,288,351 | A | 2/1994 | Hoang et al. |
| 5,365,203 | A | 11/1994 | Nakamura et al. |
| 5,382,931 | A | 1/1995 | Piloto et al. |
| 5,416,454 | A | 5/1995 | McVetty |
| 5,525,946 | A | 6/1996 | Tsujiguchi et al. |
| 5,528,204 | A | 6/1996 | Hoang et al. |
| 5,528,207 | A | 6/1996 | Ito |
| 5,537,082 | A | 7/1996 | Tada et al. |
| 5,572,175 | A | 11/1996 | Tada et al. |
| 5,602,518 | A | 2/1997 | Clifford, Jr. et al. |
| 5,719,539 | A | 2/1998 | Ishizaki et al. |
| 5,731,751 | A | 3/1998 | Vangala |
| 5,821,836 | A | 10/1998 | Katehi et al. |
| 5,850,168 | A | 12/1998 | McVetty et al. |
| 5,926,078 | A | 7/1999 | Hino et al. |
| 5,926,079 | A | 7/1999 | Heine et al. |
| 5,929,726 | A | 7/1999 | Ito et al. |
| 5,999,070 | A | 12/1999 | Endo |
| 6,002,306 | A | 12/1999 | Arakawa et al. |
| 6,023,207 | A | 2/2000 | Ito et al. |
| 6,137,383 | A | 10/2000 | De Lillo |
| 6,154,106 | A | 11/2000 | De Lillo |
| 6,160,463 | A | 12/2000 | Arakawa et al. |
| 6,181,225 | B1 | 1/2001 | Bettner |
| 6,255,921 | B1 | 7/2001 | Arakawa et al. |
| 6,281,764 | B1 | 8/2001 | Arakawa et al. |
| 6,329,890 | B1 | 12/2001 | Brooks et al. |
| 6,351,198 | B1 | 2/2002 | Tsukamoto et al. |
| 6,437,655 | B1 | 8/2002 | Andoh et al. |
| 6,504,446 | B1 | 1/2003 | Ishihara et al. |
| 6,535,083 | B1 | 3/2003 | Hageman et al. |
| 6,549,095 | B2 | 4/2003 | Tsukamoto et al. |
| 6,559,740 | B1 | 5/2003 | Schulz et al. |
| 6,568,067 | B2 | 5/2003 | Takeda |
| 6,594,425 | B2 | 7/2003 | Tapalian et al. |
| 6,677,837 | B2 | 1/2004 | Kojima et al. |
| 6,757,963 | B2 | 7/2004 | Meier et al. |
| 6,791,403 | B1 | 9/2004 | Tayrani et al. |
| 6,801,106 | B2 | 10/2004 | Ono et al. |
| 6,834,429 | B2 | 12/2004 | Blair et al. |
| 6,844,861 | B2 | 1/2005 | Peterson |
| 6,888,973 | B2 | 5/2005 | Kolodziejski et al. |
| 6,900,150 | B2 | 5/2005 | Jacquin et al. |
| 6,909,339 | B2 | 6/2005 | Yonekura et al. |
| 6,909,345 | B1 | 6/2005 | Salmela et al. |
| 6,927,653 | B2 | 8/2005 | Uchimura et al. |
| 6,977,560 | B2 | 12/2005 | Iroh et al. |
| 6,977,566 | B2 | 12/2005 | Fukunaga |
| 7,009,470 | B2 | 3/2006 | Yatabe et al. |
| 7,068,127 | B2 | 6/2006 | Wilber et al. |
| 7,132,905 | B2 | 11/2006 | Sano |
| 7,142,074 | B2 | 11/2006 | Kim et al. |
| 7,170,373 | B2 | 1/2007 | Ito et al. |
| 7,271,686 | B2 | 9/2007 | Yoshikawa et al. |
| 7,323,954 | B2 | 1/2008 | Lee et al. |
| 7,449,979 | B2 | 11/2008 | Koh et al. |
| 7,545,235 | B2 | 6/2009 | Mansour et al. |
| 7,659,799 | B2 | 2/2010 | Jun et al. |
| 7,714,680 | B2 | 5/2010 | Vangala et al. |
| 7,724,109 | B2 | 5/2010 | Knecht et al. |
| 8,008,993 | B2 | 8/2011 | Milsom et al. |
| 8,072,294 | B2 | 12/2011 | Tanpo et al. |
| 8,171,617 | B2 | 5/2012 | Vangala |
| 8,284,000 | B2 | 10/2012 | Fukunaga |
| 8,314,667 | B2 | 11/2012 | Uhm et al. |
| 8,823,470 | B2 | 9/2014 | Vangala |
| 9,030,279 | B2 | 5/2015 | Vangala |
| 9,130,255 | B2 | 9/2015 | Rogozine et al. |
| 9,130,256 | B2 | 9/2015 | Rogozine et al. |
| 9,130,257 | B2 | 9/2015 | Vangala |
| 9,130,258 | B2 | 9/2015 | Vangala et al. |
| 2001/0024147 | A1 | 9/2001 | Arkawa et al. |
| 2002/0024410 | A1 | 2/2002 | Guglielmi et al. |
| 2003/0006865 | A1 | 1/2003 | Kim et al. |
| 2004/0000968 | A1 | 1/2004 | White et al. |
| 2004/0056737 | A1 | 3/2004 | Carpintero et al. |
| 2004/0129958 | A1 | 7/2004 | Koh et al. |
| 2004/0257194 | A1 | 12/2004 | Casey et al. |
| 2005/0057402 | A1 | 3/2005 | Ohno et al. |
| 2007/0120628 | A1 | 5/2007 | Jun et al. |
| 2009/0015352 | A1 | 1/2009 | Goebel et al. |
| 2009/0102582 | A1 | 4/2009 | Van Der Heijden et al. |
| 2009/0146761 | A1 | 6/2009 | Nummerdor |
| 2009/0201106 | A1 | 8/2009 | Iio et al. |
| 2009/0231064 | A1 | 9/2009 | Bates et al. |
| 2010/0024973 | A1 | 2/2010 | Vangala |
| 2010/0253450 | A1 | 10/2010 | Kim et al. |
| 2011/0279200 | A1 | 11/2011 | Vangala |
| 2012/0229233 | A1 | 9/2012 | Ito |
| 2012/0286901 | A1 | 11/2012 | Vangala |
| 2013/0214878 | A1 | 8/2013 | Gorisee et al. |

FOREIGN PATENT DOCUMENTS

| | | | |
|---|---|---|---|
| DE | 102008017967 | A1 | 10/2009 |
| EP | 0322993 | A2 | 7/1989 |
| EP | 0322993 | A3 | 4/1990 |
| EP | 0444948 | A2 | 3/1991 |
| EP | 0757401 | A2 | 2/1997 |
| EP | 0859423 | A1 | 8/1998 |
| EP | 1024548 | A1 | 2/2000 |
| EP | 0997964 | A2 | 5/2000 |
| EP | 0997964 | A3 | 9/2001 |
| EP | 1439599 | A1 | 7/2004 |
| FR | 2318512 | A1 | 2/1977 |
| JP | 62038601 | | 2/1987 |
| JP | 2003298313 | | 10/2003 |
| JP | 2006157486 | | 6/2006 |
| WO | 9509451 | | 4/1995 |
| WO | 0024080 | | 4/2000 |
| WO | 0038270 | A1 | 6/2000 |
| WO | 2005091427 | | 9/2005 |

OTHER PUBLICATIONS

Paul Wade: "Rectangular Waveguide to Coax Transition Design", QEX, Nov./Dec. 2006, pp. 10-17, published by American Radio Relay League, Newington, Connecticut, US.

Yoji Isota, Moriyasu Miyazaki, Osami Ishida, Fumio Takeda, Mitsubishi Electric Corporation. "A Grooved Monoblock Comb-Line Filter Suppressing the Third Harmonics", IEEE 1987 MTT-S Digest, pp. 383-386, published by IEEE, New York, New York, US.

C. Choi, Fig. 2.13, Monolithic Plated Ceramic Waveguide Filters, Mar. 31, 1986, Motorola, Inc., Schaumburg, Illinois, U.S.

Kocbach J. et al: "Design Procedure for Waveguide Filters with Cross-Couplings", 2002 IEEE MTT-S International Microwave Symposium Digest (Cat. No. 02CH37278) IEEE Piscataway, NJ, USA; IEEE MTT-S International Microwave Symposium, IEEE, Jun. 2, 2002, pp. 1449-1452, XP001113877, DOI: 10.1109/WMSYM.2002.1012128 ISBN: 978-0-8703-7239-9 abstract; figure 1.

N. Marcuvitz, Waveguide Handbook, McGraw-Hill Book Co., New York City, Ch. 5, 1951.

Y. Konishi, "Novel dielectric waveguide components-microwave applications of new ceramic materials," Proc. IEEE, vo. 79, pp. 726-740, Jun. 1991.

(56) References Cited

OTHER PUBLICATIONS

K. Sano, "Dielectric waveguide filter with low profile and low insertion loss," IEEE Trans. on Microwave Theory & Tech., vol. 47, pp. 2299-2303, Dec. 1999.

K. Sano and T. Yoneyama, "A transition from Microstrip to Dielectric Filled Rectangular Waveguide in Surface Mounting," IEEE MTT-S Int. Microwave Symp. Digest, pp. 813-816, 2002.

I. Awai, A.C. Kundu, and T. Yamashita, "Equivalent circuit representation and explanation of attenuation poles of a dual-mode dielectric resonator bandpass filter," IEEE Trans. Microwave Theory & Tech., vol. 46, pp. 2159-2163, Dec. 1998.

A.D. Paidus and C. Rossiter, "Cross-coupling in microwave bandpass filters," Microwave Journal, pp. 22-46, Nov. 2004.

Tze-min Shen; Chi-Feng Chen' Huang, Ting-Yi; Wu, Ruey-Beei, "Design of Vertically Stacked Waveguide Filters in LTCC," Microwave Theory and Techniques, IEEE Transactions on, vol. 55, No. 8, pp. 1771, 1779, Aug. 2007.

Hung-Yi Chien; Tze-Min Shen; Huang; Ting-Yi; Wei-Hsin Wang; Wu, Ruey-Beei, "Miniaturized Bandpass Filters with Double-Folded Substrate Integrated Resonators in LTCC," Microwave Theory and Techniques, IEEE Transactions on vol. 57, No. 7, pp. 1774, 1782, Jul. 2009.

Bo-Jiun Chen; Tze-Min Shen; Wu, Ruey-Beei, "Dual Band Vertically Stacked Laminated Waveguide Filter Design in LTCC Technology," Microwave Theory and Techniques, IEEE Transactions on, vol. 57, No. 6, pp. 1554, 1562, Jun. 2009.

Wolfram Wersing, Microwave ceramics for resonators and filters, Current Opinion in Solid State and Materials Science, vol. 1, Issue 5, Oct. 1996, pp. 715-731, ISSN 1359-0286.

Shen T et al, Full-Wave Design of Canonical Waveguide Filters by Optimation, 2001 IEEE MTT-S International Microwave Symposium Digest. (IMS 2001) Phoenix, AZ, May 20-25, 2001, pp. 1487-1490.

John David Rhodes, The Generalized Direct-Coupled Cavity Linear Phase Filter, IEEE Transactions on Microwave Theory and Techniques, vol. MTT-18, No. 6, Jun. 1, 1970 (Jun. 1, 1970), pp. 308-313, XP001401320, abstract.

Y. Cassivi et al, Low-Cost and High-Q Millimeter-Wave Resonator Using Substrate Integrated Waveguide Technique, Microwave Conference, 2002. 32nd European, pp. 1-4.

100
146
140
136
110
147
102
106
128
530
146
147
140
110
142
124
560b
138
108
108
114
501
516
142
500
122
580
d
124a
116
102
d
540
130
106
124a
c
126
d
134
126a
124
121
126a
109
118
518
d
570b
d
126
120
132
101
112

104
181,
181a,
181b
112
L1
103

DIELECTRIC WAVEGUIDE FILTER WITH CROSS-COUPLING RF SIGNAL TRANSMISSION STRUCTURE

CROSS REFERENCE TO RELATED AND CO-PENDING APPLICATIONS

This patent application is a continuation-in-part application of, and claims the benefit of the filing date and disclosure of U.S. patent application Ser. No. 14/708,870 filed on May 11, 2015, now U.S. Pat. No. 9,437,908, which claims the benefit of the filing date and disclosure of U.S. patent application Ser. No. 13/373,862 filed on Dec. 3, 2011, now U.S. Pat. No. 9,030,279, and also claims the benefit of the filing date and disclosure of U.S. Provisional Patent Application Ser. No. 62/022,079 filed on Jul. 8, 2014, the contents of which are entirely incorporated herein by reference as well as all references cited therein.

FIELD OF THE INVENTION

The invention relates generally to a dielectric waveguide filter and, more specifically, to a dielectric waveguide filter with a cross-coupling RF signal transmission structure.

BACKGROUND OF THE INVENTION

This invention is related to a dielectric waveguide filter of the type disclosed in U.S. Pat. No. 9,030,279 to Vangala that comprises a pair of blocks of dielectric material that, have been coupled together and in which each of the blocks includes a plurality of resonators spaced longitudinally alone the length of the block and further in which a plurality of RF signal bridges of dielectric material between the plurality of resonators provide a direct inductive/capacitive coupling between the plurality of resonators.

The attenuation characteristics of the dielectric waveguide filter disclosed in U.S. Pat. No. 9,030,279 to Vangala can be increased by cross-coupling of the resonators in the pair of adjacent blocks by a cross-coupling RF signal transmission structure or bar that is seated on the top surface of, and extends between, the pair of blocks and allows for a portion of the RF signal to be transmitted from the one of the resonators of one of the pair of blocks directly into the one of the resonators in the other of the pair of blocks.

The present invention is directed to a dielectric waveguide filter with new cross-coupling RF signal transmission structure embodiments.

SUMMARY OF THE INVENTION

The present invention relates generally to a waveguide filter comprising a block of dielectric material, a plurality of resonators defined in the block of dielectric material, an internal layer of conductive material between and separating the plurality of resonators, the plurality of resonators defining a first direct RF signal transmission path for the transmission of an RF signal through the waveguide filter, and an external substrate coupled to an exterior surface of the block of dielectric material, the substrate defining a pair of RF signal input/output transmission vias filled with a conductive material and an interior RF signal transmission line of conductive material extending between and interconnecting the pair or RF signal input/output transmission vias and providing an indirect cross-coupling path for the transmission of a portion of the RF signal between a pair of the plurality of resonators separated by the internal layer of conductive material.

In one embodiment, the pair of RF signal input/output transmission vias define respective openings in opposed exterior surfaces of the substrate covered with a layer of conductive material defining a ground layer and a pair of isolated RF signal input/output pads surrounding the openings defined in the opposed exterior surfaces by the pair of RF signal input/output transmission vias.

In one embodiment, the external substrate defines a second plurality of ground vias filled with the conductive material and terminating in respective openings in the ground layer of conductive material on the respective exterior surfaces.

In one embodiment, the external substrate is in the form of a bar that bridges the pair of the plurality of resonators and the internal layer of conductive material.

In one embodiment, the external substrate is in the form of a base for the block of dielectric material.

The present invention is also directed to a waveguide filter comprising a first block of dielectric material defining a first plurality of resonators, a first RF signal input/output electrode defined on the first block of dielectric material, a second block of dielectric material coupled to the first block of dielectric material, the second block of dielectric material defining a second plurality of resonators, a second RF signal input/output electrode defined on the second block of dielectric material, an interior layer of conductive material between and separating the first and second blocks of dielectric material, a first direct generally U-shaped RF signal transmission path defined by the combination of the first and second RF signal input/output electrodes and the first and second plurality of resonators in the first and second blocks of dielectric material, and an external substrate defining a first pair of RF signal input/output transmission vias filled with a conductive material and an interior RF signal transmission line of conductive material extending between and interconnecting the pair or RF signal input/output transmission vias and providing an indirect cross-coupling path for the transmission of a portion of the RF signal between one of the first plurality of resonators in the first block of dielectric material and one of the second plurality of resonators in the second block of dielectric material.

In one embodiment, the pair of RF signal input/output transmission vias terminate in respective openings in the opposed exterior surfaces of the substrate, the opposed exterior surfaces of the substrate being covered with a layer of conductive material defining a ground layer and a pair of isolated RF signal input/output pads surrounding the openings defined in the opposed exterior surfaces by the pair of RF signal input/output transmission vias.

In one embodiment, the external substrate defines a second plurality of ground vias filled with the conductive material and terminating in respective openings in the ground layer of conductive material on the respective exterior surfaces.

In one embodiment, the external substrate is in the form of a bar that bridges two of the plurality of resonators and the internal layer of conductive material.

In one embodiment, the external substrate is in the form of a base for the block of dielectric material.

In one embodiment, the external substrate includes a region of electric material that extends over one of the pair of isolated RF signal input/output pads and a portion of the wound layer of conductive material for tuning the waveguide filter.

In one embodiment, a slot in the external substrate provides access to the interior RF signal transmission line and allows for trimming the conductive material of the RF signal transmission line for tuning the waveguide filter.

The present invention is further directed to an external substrate adapted to be coupled to an exterior surface of a waveguide filter including at least first and second blocks of dielectric material coupled together and separated by an interior layer of conductive material, the first and second blocks of dielectric material defining a plurality of resonators defining a direct RF signal transmission path for the transmission of an RF signal, the substrate defining a pair of RF signal input/output transmission vias filled with a conductive material and an interior RF signal transmission line of conductive material extending between and interconnecting the pair or RF signal input/output transmission vias and providing an indirect cross-coupling path for the transmission of a portion of the RF signal between one of the resonators in the first block of dielectric material and one of the resonators in the second block of dielectric material.

In one embodiment, the external substrate is in the form of a bar that bridges the one of the resonators in the first block of dielectric material and the one of the resonators in the second block of dielectric material.

In one embodiment, the external substrate is in the form of a mounting base for the first and second blocks of dielectric material.

Other advantages and features of the present invention will be more readily apparent from the following detailed description of the preferred embodiments of the invention, the accompanying drawings, and the appended claims.

BRIEF DESCRIPTION OF THE DRAWINGS

These and other features of the invention can best be understood by the following description of the accompanying FIGURES as follows.

DETAILED DESCRIPTION OF THE EMBODIMENTS

Figure 1:
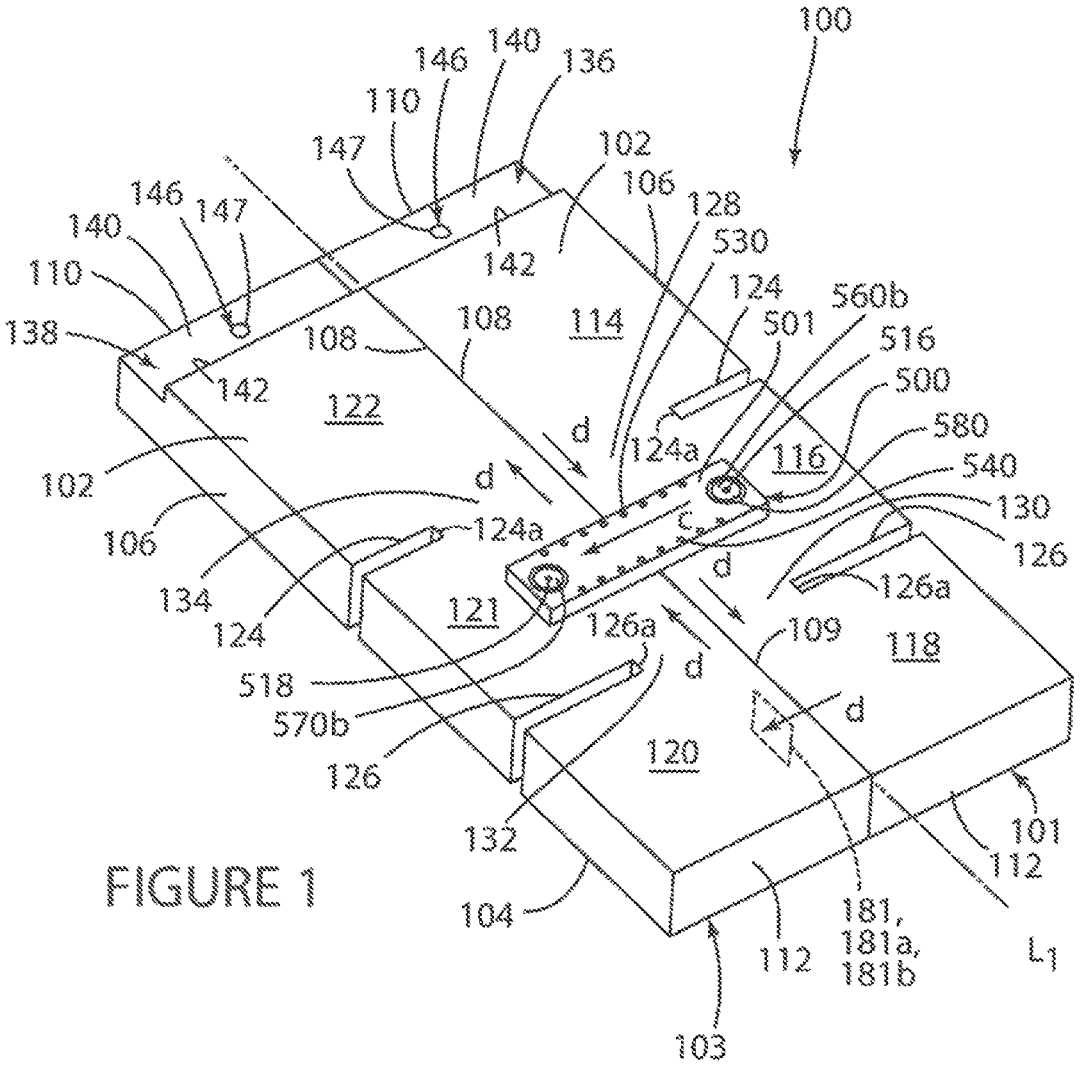
FIG. 1 is an enlarged perspective view of a dielectric waveguide filter according to the present invention.
Figure 2:
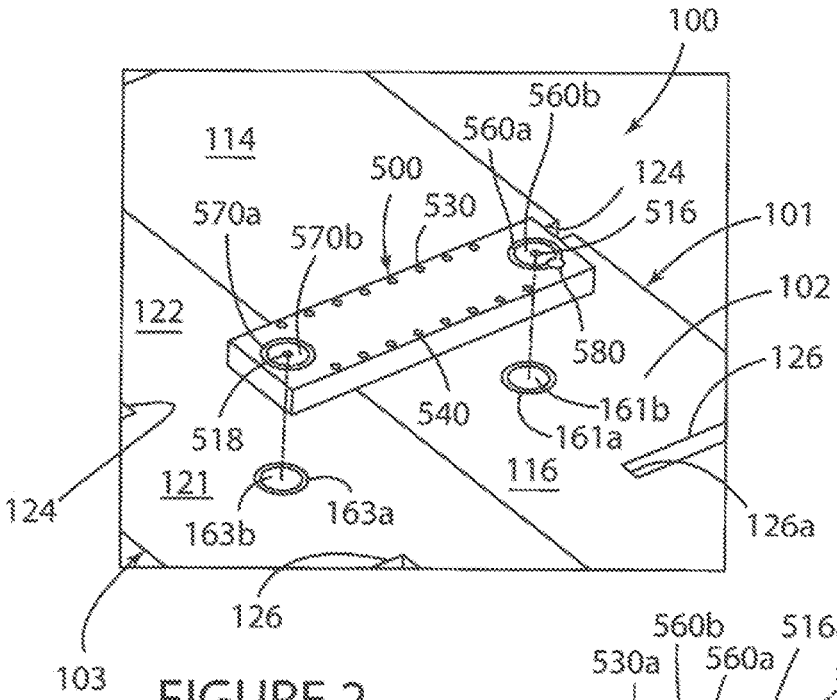
FIG. 2 is an enlarged cut away perspective view of the dielectric waveguide filter shown in FIG. 1 with the cross-coupling RF signal transmission structure or bar shown exploded away from the surface of the dielectric waveguide filter.
Figure 3:
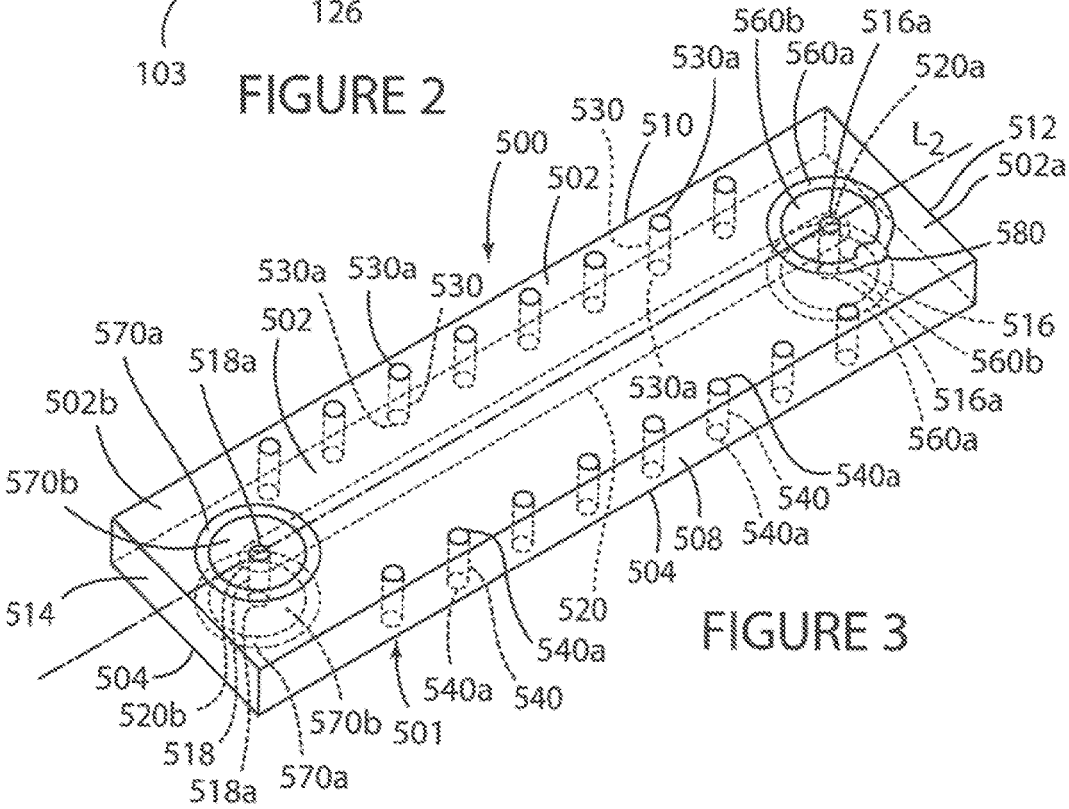
FIG. 3 is an enlarged, part phantom, perspective view of the cross-coupling RF signal transmission structure or bar of the dielectric waveguide filter shown in FIG. 1.

FIGS. 1, 2, and 3 depict a first embodiment of a ceramic dielectric waveguide filter 100 in accordance with the present invention which is adapted for the transmission and/or filtering of an RF signal and is made from a pair of separate generally parallelepiped-shaped solid blocks 101 and 103 that have been coupled together in an abutting side-by-side relationship to form the generally rectangular waveguide filter 100 as also described in more detail below.

Each of the solid blocks 101 and 103 is comprised of a suitable dielectric material, such as for example ceramic; includes opposed longitudinal horizontal exterior surfaces 102 and 104 extending longitudinally in the same direction as the longitudinal axis $L_1$ and defining the upper and lower longitudinal exterior horizontal surfaces 102 and 104 of the waveguide filter 100; opposed longitudinal side vertical exterior surfaces 106 and 108 extending longitudinally in the same direction as the longitudinal axis $L_1$ with the surfaces 106 defining the opposed longitudinal side vertical exterior surfaces 106 of the waveguide filter 100 and the surfaces 108 being abutted against each other and co-linear with the longitudinal axis $L_1$; and opposed transverse side vertical exterior end surfaces 110 and 112 extending in a direction generally normal to the longitudinal axis $L_1$ and defining the opposed transverse side vertical exterior end surfaces 110 and 112 of the waveguide filter 100.

Each of the blocks 101 and 103 includes a plurality of resonant sections (also referred to as cavities or cells or resonators) 114, 116, and 118 and 120, 121, and 122 respectively which extend in a spaced apart relationship along and in the same direction as the longitudinal axis $L_1$ of waveguide filter 100 and are separated from each other by a plurality of (and more specifically two in the embodiment of FIG. 1) spaced-apart vertical slits or slots 124 and 126 which are cut into the respective surfaces 106 of the respective blocks 101 and 103 and RF signal bridges 128, 130, 132, and 134 of dielectric material as described in more detail below.

The first pair of slots 124 and 126 extend along the length of the side surface 106 of the block 101 in a spaced-apart and parallel relationship relative to each other and in a relationship generally normal to the longitudinal axis $L_1$. Each of the slots 124 and 126 cuts through the side surface 106 and the opposed horizontal surfaces 102 and 104 and partially through the body and the dielectric material of the block 101.

The second pair of slots 124 and 126 extend along the length of the side surface 106 of the block 103 in a spaced-apart and parallel relationship relative to each other; in a relationship generally normal to the longitudinal axis $L_1$; and in a relationship opposed, co-linear, and co-planar with the respective slots 124 and 126 defined in the block 101. Each of the slots 124 and 126 in the block 103 cuts through the side surface 106 and the opposed horizontal surfaces 102 and 104 and partially through the body and the dielectric material of the block 103.

In the embodiment of FIGS. 1 and 2, the slot 124 in each of the blocks 101 and 103 is located spaced and opposite from and generally parallel to the end exterior surface 110 of the respective blocks 101 and 103 and has a length approximately equal to about one half the width of the respective blocks 101 and 103.

In the embodiment of FIGS. 1 and 2, the slot 126 in each of the blocks 101 and 103 is located spaced and opposite from and generally parallel to the opposed end exterior surface 112 of the respective blocks 101 and 103 and has a length approximately equal to about three quarters the with of the respective blocks 101 and 103.

Thus, in the embodiment of FIGS. 1 and 2, the slots 124 and 126 define respective ends 124*a* and 120*a* located opposite and spaced from the side surface 108 of the respective blocks 101 and 103 and together with the respective surfaces 108 define respective RF signal bridges 128 and 130 and RF signal bridges 132 and 134 in the blocks 101 and 103 respectively which are each comprised of a bridge or island of dielectric material which extends in the vertical direction between the surfaces 102 and 104 of each of the blocks 101 and 103 and in the horizontal direction between the respective ends 124*a* and 126*a* of the respective slots 124 and 126 and the respective surfaces 108.

The bridge 128 of dielectric material on the block 101 bridges and interconnects the dielectric material of the resonator 114 to the dielectric material of the resonator 116, while the bridge 130 of dielectric material interconnects the dielectric material of the resonator 116 to the dielectric material of the resonator 118. In a similar manner, the bridge 132 of dielectric material on the block 103 interconnects the dielectric material of the resonator 120 to the dielectric material of the resonator 121, while the bridge 134 of dielectric material bridges and interconnects the dielectric material of the resonator 121 to the dielectric material of the resonator 122.

In the embodiment shown, the width of each of the RF signal bridges or islands of dielectric material 128, 130, 132, and 134 is dependent upon the length of the respective slots 124 and 126 and, more specifically, is dependent upon the distance between the respective ends 124*a* and 126*a* of the respective slots 124 and 126 and the side surface 108 of the respective blocks 101 and 103.

Although not shown in any of the FIGURES, it is understood that the thickness or width of the slots 124 and 126 and the depth or distance which the slots 124 and 126 extend from the side surface 106 into the body and dielectric material of each of the blocks 101 and 103 may be varied depending upon the particular application to allow the width and the length of the RF signal bridges 128, 130, 132, and 134 to be varied accordingly to allow control of the electrical coupling and bandwidth of the waveguide filter 100 and hence control the performance characteristics of the waveguide filter 100.

The blocks 101 and 103 additionally comprise and define respective end steps or notches 136 and 138 respectively and each comprising, in the embodiment shown, a generally L-shaped recessed or grooved or shouldered or notched region or section of the longitudinal horizontal surface 102, opposed side surfaces 106 and 108, and side end surfaces 110 of the respective blocks 101 and 103, and more specifically of the respective end resonators 114 and 122, from which dielectric ceramic material has been removed or is absent.

Stated another way, the respective steps 136 and 138 are defined in and by a stepped or recessed end section or region of each of the respective blocks 101 and 103, and more specifically by a stepped or recessed end section or region of the portion of the respective blocks 101 and 103 defining the respective resonators 114 and 122, having a height less than the height of the remainder of the respective blocks 101 and 103.

Stated yet another way, the respective steps 136 and 138 each comprise a generally L-shaped recessed or notched portion of the respective end resonators 114 and 122 defined on the respective blocks 101 and 103 which includes a first generally horizontal surface 140 located or directed inwardly of, spaced from, and parallel to the horizontal surface 102 of the respective blocks 101 and 103 and a second generally vertical surface or wall 142 located or directed inwardly of, spaced from, and parallel to, the side end surface 110 of the respective blocks 101 and 103.

In the embodiment shown, the surface 140 and the wall 142 of the respective steps 136 and 138 are located between the side end surface 110 and the slot 124 of the respective blocks 101 and 103 with the surface 140 terminating and cutting into the side end surface 110 and the surface 140 and the wall 142 terminating at a point and location in the body of the respective blocks 101 and 103 that is spaced from and short of the slot 124.

The blocks 101 and 103 additionally each comprise an electrical RF signal input/output electrode in the form of respective through-holes 146 extending through the body of the respective blocks 101 and 103 in a relationship generally normal to the longitudinal axis $L_1$ thereof and, more specifically, through the respective steps 136 and 138 thereof and, still more specifically, through the body of the respective end resonators 114 and 122 defined in the respective blocks 101 and 103 between, and in relationship generally normal to, the surface 140 of the respective steps 136 and 138 and the surface 102 of the respective blocks 101 and 103.

Still more specifically, the respective RF signal input/output through-holes 146 are spaced from and generally parallel to and located between the respective transverse side end surface 110 and the wall 142 of the respective blocks 101 and 103 and define respective generally circular openings 147 terminating in the top step surface 140 and the bottom block surface 102 respectively of each of the respective blocks 101 and 103.

All of the external surfaces 102, 104, 106, 108, 110, and 112 of the blocks 101 and 103, the internal surfaces of the slots 124 and 126, and the internal surfaces of the input/output through-holes 146 are covered with a suitable conductive material such as for example silver except as otherwise described below.

Specifically, as show in FIG. 2, the blocks 101 and 103 include respective ring shaped regions or portions of dielectric material 161*a* and 163*a* formed on the top surface 102 (i.e., regions or portions devoid of conductive material) which define respective isolated circular RF signal input/output regions or pads or electrodes 161*b* and 163*b* respectively. In the embodiment shown, the RF signal input/output pads 161*b* and 163*b* are positioned relative to each other in a diametrically opposed relationship on opposite sides of and spaced from the longitudinal axis $L_1$ and are located on the top surface 102 in the regions of the respective resonators 116 and 121 and between and space from the respective slots 124 and 126.

Additionally, as shown in FIG. 1, the blocks 101 and 103, and more specifically the exterior side surfaces 108 thereof, include respective generally rectangular shaped regions of dielectric material 181*a* and 181*b* (i.e., regions on the respective exterior surfaces 108 devoid of conductive material) that together define an interior RF signal transmission window 181 when the blocks 101 and 103 are coupled together in the side-by-side relationship along the respective side surfaces 108 of the respective blocks 101 and 103. In the embodiment shown, the regions of dielectric material 181*a* and 181*b* and the resultant interior RF signal transmission window 181 are located in the region of the surface 108 of the respective blocks 101 and 103 defining the respective end resonators 118 and 120 and still more specifically in the region of the respective blocks 101 and 103 located between and spaced from the respective slots 126 and the respective exterior end surfaces 112 of the respective blocks 101 and 103 and further more specifically at the end of the respective blocks 101 and 103 opposite the end thereof with the steps 136 and 138.

As shown in FIG. 1, the separate blocks 101 and 103 are, in the embodiment shown, coupled and secured to each other to define and form the waveguide filter 100 in accordance with the present invention in which a plurality of resonators are arranged in one or more rows and columns and, more specifically, in the embodiment shown, in a relationship in which six resonators 114, 116, 118, 120, 121, and 122 are arranged in two rows and three columns as described in more detail below.

Specifically, and as shown in FIG. 1, the blocks 101 and 103 are coupled and secured together to define the waveguide filter 100 in a side-by-side relationship wherein the vertical side surface 108 of the block 101 is abutted against and secured to the vertical side surface 108 of the bock 103, defines an interior longitudinally extending layer or strip of conductive material 109 that extends in a relationship co-planar with the longitudinal axis $L_1$ of the waveguide filter 100, is defined by the layer of conductive material covering the exterior surface 108 of each of the respective blocks 101 and 103, and separates the resonators 114, 116, and 118 from the resonators 120, 121, and 122; the slots 124 and 126 on the block 101 are co-linearly aligned with the slots 124 and 126 on the block 103; the step 136 on the block 101 is abutted against and aligned with the step 138 on the block 103; and the regions of dielectric material 181*a* and 181*b* are disposed in an aligned and co-linear relationship and define the interior RF signal transmission window 181.

Thus, in the relationship as shown in FIG. 1, the resonators 114, 116, and 118 on the block 101 defining the waveguide filter 100 are arranged in a first row; the resonators 120, 121, and 122 on the block 103 defining the filter 100 are arranged in an abutting second row that is electrically separated from the resonators 114, 116, and 118 by the internal layer of conductive material 109 defined by the layer of conductive material covering the exterior surface 108 of the respective blocks 101 and 103; the respective resonators 114 and 122 on the respective blocks 101 and 103 are disposed in an abutting, side-by-side column relationship; the respective resonators 116 and 121 on the respective blocks 101 and 103 are disposed in an abutting, side-by-side column relationship; and the respective resonators 118 and 120 on the respective blocks 101 and 103 are disposed in an abutting, side-by-side column relationship.

The waveguide filter 100 defines a first magnetic or inductive generally U-shaped direct coupling RF signal transmission path or transmission line for RF signals generally designated by the arrows d in FIG. 1. Specifically, an RF signal is adapted to be transmitted and pass successively through the RF signal transmission input through-hole 146 extending through the step 136 formed in the block 101; the step 136 in the resonator 114 of the block 101; the resonator 114 in the block 101; the resonator 116 in the block 101 via and through the RF signal bridge 128; and the resonator 118 in the block 101 via and through the RF signal bridge 130.

Thereafter, the RF signal is transmitted into the resonator 120 of the block 103 via and through the internal or interior direct coupling RF signal transmission means defined by the internal RF signal transmission window 181 defined in the interior layer 109 of conductive material located between and separating the two blocks 101 and 103 and, more specifically, between and separating the two resonators 118 and 120; and then through the resonator 121 in the block 103 via the RF signal bridge 132; the resonator 122 in the block 103 via and through the RF signal bridge 134; the step 138 at the end of the resonator 122 of the block 103; and out through the RF signal transmission output through-hole 146 in the step 138.

The waveguide filter 100 additionally comprises a first indirect, alternative, or cross-coupling RF signal transmission means or structure 500 which, in the embodiment shown, is in the form of an external, cross-coupling/indirect coupling, bypass or alternate RF signal transmission electrode or bridge member or printed circuit board or substrate in the form of an elongate and generally rectangular bar 501 having a specific impedance and phase and extending between and interconnecting and electrically coupling and interconnecting the respective resonators 116 and 121 of the respective blocks 101 and 103.

In the embodiment shown, the bar 501 is seated on and bridges the respective upper horizontal exterior surfaces 102 of the blocks 101 and 103 and, more specifically, the bar 501 bridges the two resonators 110 and 121 and the interior layer of conductive material 109 therebetween and extends in a relationship normal to and intersecting and bridging the longitudinal axis $L_1$ of the waveguide filter 100.

Ire accordance with this embodiment of the present invention, the waveguide filter 100 also defines and provides an alternate or indirect- or cross-coupling RF signal transmission path for RF signals generally designated by the arrow c in FIG. 1 and is defined and created by the external RF signal transmission structure 500 which allows for the transmission of a small portion of the direct RF signal being transmitted through the resonator 116 of the block 101 to be transmitted directly into the resonator 121 of the block 103.

As more particularly shown in FIG. 3, the bar 501 includes and defines first and second RF signal input/output transmission through-holes or vias 516 and 518 that: are located at the respective ends 502*a* and 502*b* of the bar 501 in a relationship spaced and opposed from the respective end transverse exterior vertical surfaces 512 and 514 of the bar 501; extend through the interior of the printed circuit board or bar 501 in a relationship generally normal to the respective upper and lower horizontal exterior surfaces 502 and 504: and terminate in respective openings in the respective 516*a* and 518*a* in the respective upper and lower horizontal exterior surfaces 502 and 504.

Additionally, and as shown in FIG. 3, the bar 501 further includes an elongate interior RF signal transmission line 520 that is comprised of an elongate strip of conductive metal that extends through the interior of the bar 501 and includes a first end 520*a* in coupling relationship with the first RF signal input/output transmission through-hole 516 and an opposed second end 520*b* in coupling relationship with the second RF signal input/output transmission through-hole 518. In the embodiment shown, the interior RF signal transmission line 520 is located generally centrally in the interior of the printed circuit board or bar 501 and extends through the interior thereof in the same direction as and co-linear with the Longitudinal axis $L_2$ of the bar 501 and further in a relationship spaced and parallel to the opposed longitudinally extending vertical exterior surfaces 508 and 510 of the bar 501.

The bar 501 additionally includes a first and second plurality through-holes or vias 530 and 540 extending through the interior of the bar 501 in a relationship and orientation generally normal to the respective upper and lower horizontal exterior surfaces 502 and 504 with each of the through-holes 530 terminating in respective upper and lower openings 530*a* and 540*a* in the respective upper and lower horizontal exterior surfaces 502 and 504.

The first plurality of through-holes 530 are positioned in a co-linear and spaced apart relationship relative to each other on a first side of and spaced from and parallel to the longitudinal axis $L_2$ and the interior RF signal transmission line 520 while the second plurality of through-holes 540 are positioned in a co-linear and spaced apart relationship relative to each other and on an opposite second side of and spaced from and parallel to the longitudinal axis $L_2$ and the interior RF signal transmission line 520.

Stated another way, in the embodiment shown, the first plurality of through-holes 530 is located on one side of the longitudinal axis $L_2$/RF signal transmission line 520 and, more specifically, between the longitudinal axis $L_2$/RF signal transmission line 520 and the longitudinal exterior vertical surface 510 and the second plurality of through-holes 540 is located on the other side of the longitudinal axis $L_2$/RF signal transmission line 520 and, more specifically, between the longitudinal axis $L_2$/RF signal transmission line 520 and the opposed longitudinal exterior vertical surface 508.

In the embodiment of the bar 501 shown in FIGS. 1, 2, and 3, the respective upper and lower longitudinally extending exterior surfaces 502 and 504 are covered with a layer of conductive metal such as silver or the like, and the interior of the RF signal input/output transmission through-holes 516 and 518 and the interior of each of the through-holes the first and second plurality of through-holes 530 and 540 are filled with the same conductive metal.

Moreover, in the embodiment of FIGS. 1, 2, and 3, the bar 501 includes a pair of ring-shaped regions 560*a* and 570*a* that are defined on each of the respective surfaces 502 and 504; surround and are spaced from the respective openings 516*a* and 518*a* defined in the respective RF surfaces 502 and 504 of the bar 501 by the respective RF signal input/output through-holes 516 and 518; represent and define regions of dielectric material on the respective surfaces 502 and 504 (i.e., regions devoid of conductive metal); and define respective RF signal input/output pads or regions or electrodes of conductive material 560*b* and 570*b* that surround the respective openings 516*a* and 518*a* and are isolated from the remainder of the conductive metal on the respective surfaces 502 and 504 that defines respective upper and lower ground layers or planes of conductive material.

Thus, in the embodiment shown, the respective openings 516*a* and 518*a* of the respective through-holes or vias 516 and 518 terminate in the conductive material of the respective RF signal input/output pads 560*a* and 570*a* while the respective openings 530*a* and 540*a* of the respective through-holes or vias 530 and 540 terminate in the ground plane or layer of conductive metal on the respective surfaces 502 and 504.

Thus, in accordance with the present invention, the bar 501 is seated on the top surface 102 of the waveguide filter 100 and the respective blocks 101 and 103 thereof in a relationship with the respective bar RF signal input/output pads 560*b* and 570*b* abutted against the respective waveguide filter RF signal input/output pads 161*b* and 163*b* respectively for allowing a small portion of the direct RF signal being transmitted through the resonator 116 of the block 101 to be transmitted directly from the resonator 116 into the bar 501 via and through the RF signal input/output through-hole 516, and then through the interior RF signal transmission line 520, and then through the RF signal input/output through-hole 518 and then into the resonator 121 of the block 103.

Further, in accordance with the present invention, the performance characteristics of the waveguide filter 100 can be adjusted or tuned by forming or creating one or more additional regions or portions on the upper horizontal surface 504 of the printed circuit board or bar 501 which are without or devoid of conductive material such as for example the additional circular region or portion 580 shown in FIG. 2 which covers and spans a portion of the RF signal input/output pad 560*b*, the ring-shaped region 560*a*, and a portion of the conductive material that covers the remainder of the upper horizontal surface 504 of the printed circuit board or bar 501.

The performance characteristics of the waveguide filter 100 can further be adjusted by for example enlarging or reducing the size of the ring-shaped regions 560*a* and 570*a* and the region or portion 580.

Figure 4:
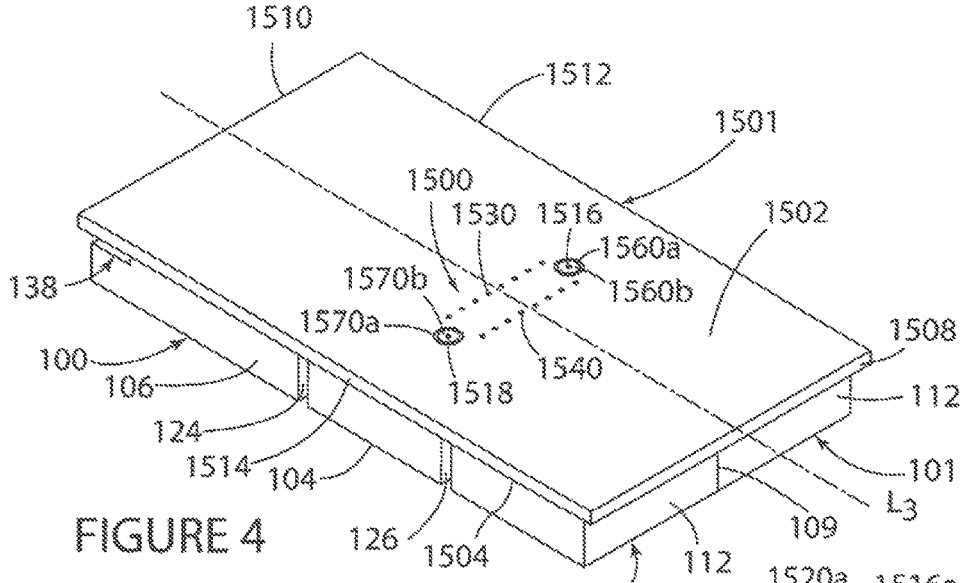
FIG. 4 is an enlarged perspective view of another embodiment of a dielectric waveguide filter in which a cross-coupling RF signal transmission line has been incorporated into the interior of a waveguide filter mounting substrate.
Figure 5:
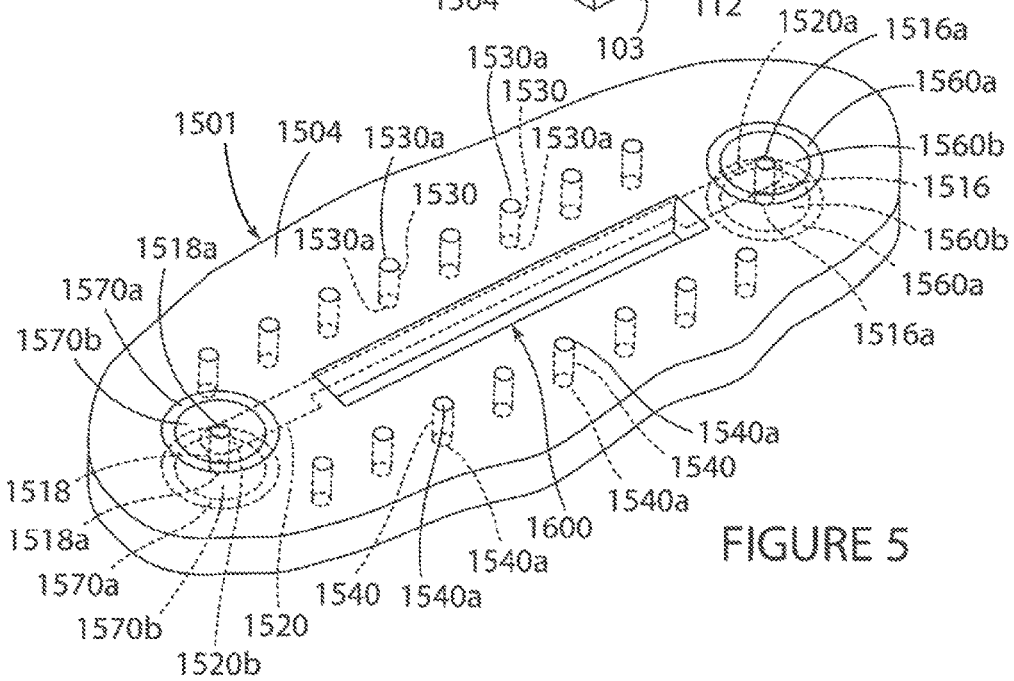
FIG. 5 is an enlarged perspective view of the waveguide filter mounting substrate shown in FIG. 4 further incorporating a slot adapted to allow access to and trimming of the interior RF signal transmission line for tuning the waveguide filter.

FIGS. 4 and 5 depict an embodiment in which the waveguide filter 100 shown in FIG. 1 has been mounted on a generally rectangular shaped printed circuit board or substrate 1501 that includes a cross-coupling RF signal transmission structure 1500 similar in structure and function to the cross-coupling RF signal transmission structure 500 disclosed and described earl earlier with regard to FIGS. 1, 2, and 3 except that the printed circuit board or bar 501 shown in FIGS. 1, 2, and 3 has been substituted with a larger printed circuit board or substrate 1501 which serves the dual purposes of providing a mounting base or plate for the waveguide filter 100 and incorporating the cross-coupling RF signal transmission structure 1500.

In the embodiment shown, the printed circuit board or substrate 1501 includes respective upper and lower exterior horizontal surfaces 1502 and 1504 and the waveguide filter 100 is mounted on the lower exterior horizontal surface 1504. In the embodiment shown, the substrate 1501 covers the entire lower horizontal surface 1504 of the waveguide filter 100.

Further, in the embodiment shown, the cross-coupling RF signal transmission structure 1500 is incorporated into the interior of, and is generally centrally located in, the printed circuit board or substrate 1501 and includes first and second co-linear and spaced RF signal input/output transmission through-holes or vias 1516 and 1518 that extend through the interior of the printed circuit board or substrate 1501 in a relationship generally normal to the respective upper and lower horizontal exterior surfaces 1502 and 1504 and terminate in respective openings 1516*a* and 1518*a* in the respective upper and lower horizontal exterior surfaces 1502 and 1504.

Additionally, and as shown in FIG. 5, the cross-coupling RF signal transmission structure 1500 additionally includes an elongate interior RF signal transmission line 1520 that extends through the interior of the printed circuit board or substrate 1501 in a relationship co-linear with the RF signal input/output transmission through-holes 1516 and 1518 and includes a first end 1520*a* in electrical coupling relationship with the first RF signal input/output transmission through-hole 1516 and an opposed second end 1520*b* in electrical coupling relationship with the second RF signal input/output transmission through-hole 1518.

In the embodiment shown, the cross-coupling RF signal transmission structure 1500 is incorporated and positioned in the interior of the printed circuit board or substrate 1501 in a relationship wherein the interior RF signal transmission line 1520 that is made of conductive metal extends through the interior thereof in the same direction as the opposed transverse exterior vertical surfaces 1508 and 1510 of the printed circuit board or substrate 1501 and further in a relationship generally normal to the opposed longitudinal exterior vertical surfaces 1512 and 1514 of the printed circuit board or substrate 1501 and still further in a relationship generally normal and intersecting the longitudinal axis $L_3$ of the printed circuit board or substrate 1501.

The printed circuit board or substrate 1501 additionally includes a first and second plurality of through-holes or vias 1530 and 1540 extending through the interior of the printed circuit board or bar 1501 in a relationship wherein the individual through-holes of the respective first and second plurality of through-holes 1530 and 1540 are positioned relative to each other in a co-linear and spaced apart relationship relative to each other and further wherein the respective first and second plurality of through-holes 1530 and 1540 are positioned relative to each other in a relationship, orientation, and position generally spaced, parallel to, and on opposite sides of, the interior RF signal transmission line 1520 with each of the individual through-holes of the first and second plurality of through-holes 1530 and 540 terminating in respective upper and lower openings 1530*a* and 1540*b* in the respective upper and lower horizontal exterior surfaces 1502 and 1504 of the printed circuit board or substrate 1501.

The exterior surface of the respective upper and lower longitudinally extending exterior surfaces 1502 and 1504 of the printed circuit board or substrate 1501 are covered with a layer of conductive metal such as silver or the like, and the interior of the RF signal input/output transmission through-holes 1516 and 1518 and the interior of each of the through-holes in the first and second plurality of through-holes 1530 and 1540 are filled with the same conductive metal.

The printed circuit board or substrate 1501, and more specifically the cross-coupling RF signal transmission structure 1500, further comprises a pair of ring-shaped regions 1560*a* and 1570*a* on the respective surfaces 1502 and 1504 that surround and are spaced from the respective openings 1516*a* and 1516*b* defined in the respective surfaces 1502 and 1504 of the printed circuit board or substrate 1501 by the respective RF signal input/output through-holes 1516 and 1518; comprise regions of dielectric material (i.e., regions devoid of conductive material); and define respective RF signal input/output pads or regions or electrodes of conductive material 1560*b* and 1570*b* that surround the respective openings 1516*a* and 1516*b* and are isolated from the remainder of the conductive metal on the respective surfaces 1502 and 1504 that define respective upper and lower ground planes or layers of conductive material on the respective surfaces 1502 and 1504.

Thus, in the embodiment shown, the respective openings 1516*a* and 1518*a* of the respective through-holes or vias 1516 and 1518 terminate in the conductive material of the respective pads 1560*a* and 1570*a* while the respective openings 1530*a* and 1540*a* of the respective through-holes or vias 1530 and 1540 terminate in the respective ground plane or layer of conductive metal on the respective surfaces 1502 and 1504.

In accordance with the present invention, the printed circuit board or substrate 1501, and more specifically the cross-coupling RF signal transmission structure 1500, allows for a small portion of the direct RF signal being transmitted through the resonator 116 of the block 101 to be transmitted directly into the printed circuit board or substrate 1501 via and through the RF signal input/output through-hole 1516, and then through the interior RF signal transmission line 1520, and then through the RF signal input/output through-hole 1518 and then into the resonator 121 of the block 103.

In accordance with the invention and as shown in FIG. 5, an elongate slot 1600 may be cut and defined in the body of the printed circuit board or substrate 1501 in the region thereof incorporating the internal RF signal transmission line 1520 to allow and provide access to the RF signal transmission line 1520 and more specifically to allow the conductive metal defining the RF signal transmission line 1520 to be trimmed (i.e. removed or sliced) therefrom for tuning the performance of the waveguide filter 100.

Figure 6:
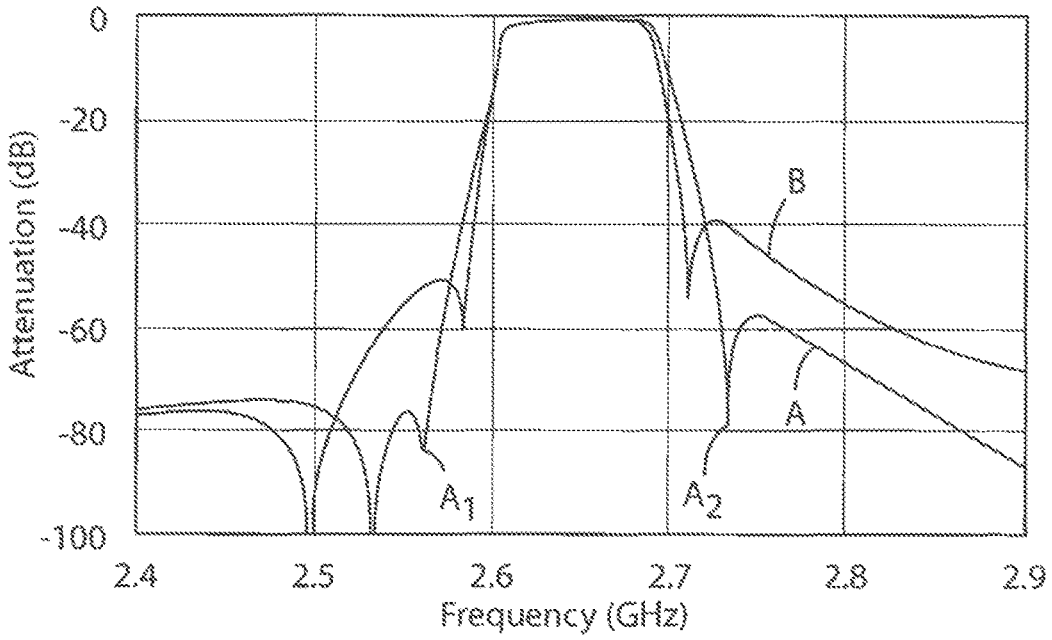
FIG. 6 is a graph representing the performance/frequency response of the ceramic dielectric waveguide filter with a cross-coupling RF signal transmission structure according to the present invention.

FIG. 6 is a graph of the performance/frequency response of the waveguide filter 100 in which Attenuation (measured in dB) is shown along the vertical axis and Frequency (measured in MHz) is shown along the horizontal axis. Specifically, the line generally designated A in FIG. 6 represents the performance of the tuned waveguide filter 100 shown in FIG. 1 which has been tuned via formation of region or portion 580 on the top surface of the cross-coupling bar 501 and also the performance of the tuned waveguide filter 100 shown in FIGS. 4 and 5 which has been tuned by trimming of the transmission line 1520. The notches A1 and A2 on the line A are created by the cross-coupling bar 501 shown in FIG. 1 and the cross-coupling structure 1500 shown in FIG. 4. The line generally designated B in FIG. 6 represents the performance of an untuned waveguide filter 100 without the region or portion 580 or a trimmed transmission line 1520.

While the invention has been taught with specific reference to the embodiments shown, it is understood that a person of ordinary skill in the art will recognize that changes can be made in form and detail without departing from the spirit and the scope of the invention. The described embodiments are to be considered in all respects only as illustrative and not restrictive.

We claim:

1. A waveguide filter comprising:

a block of dielectric material;

a plurality of resonators defined in the block of dielectric material;

an internal layer of conductive material between and separating the plurality of resonators;

the plurality of resonators defining a first direct RF signal transmission path for the transmission of an RF signal through the waveguide filter; and an external substrate coupled to an exterior surface of the block of dielectric material, the substrate defining a pair of RF signal input/output transmission vias filled with a conductive material and an interior RF signal transmission line of conductive material extending between and interconnecting the pair of RF signal input/output transmission vias and providing an indirect cross-coupling path for the transmission of a portion of the RF signal between a pair of the plurality of resonators separated by the internal layer of conductive material.

2. The waveguide filter of claim 1 wherein the pair of RF signal input/output transmission vias define respective openings in opposed exterior surfaces of the substrate covered with a layer of the conductive material, the layer of the conductive material defining a ground layer and a pair of isolated RF signal input/output pads surrounding the openings defined in the opposed exterior surfaces of the substrate by the pair of RF signal input/output transmission vias.

3. The waveguide filter of claim 2 wherein the external substrate defines a second plurality of ground vias filled with the conductive material and terminating in respective second openings in the ground layer of the conductive material on the respective exterior surfaces of the substrate.

4. The waveguide filter of claim 3 wherein the external substrate is in the form of a bar that bridges the pair of the plurality of resonators and the internal layer of conductive material.

5. The waveguide filter of claim 3 wherein the eternal substrate is in the form of a base for the block of dielectric material.

6. A waveguide filter comprising:

a first block of dielectric material defining first plurality of resonators;

a first RF signal input/output electrode defined on the first block of dielectric material;

a second block of dielectric material coupled to the first block of dielectric material, the second block of dielectric material defining a second plurality of resonators;

a second RF signal input/output electrode defined on the second block of dielectric material;

an interior layer of conductive material between and separating the first and second blocks of dielectric material;

a first direct generally U-shaped RF signal transmission path defined by the combination of the first and second RF signal input/output electrodes and the first and second plurality of resonators in the first and second blocks of dielectric material; and an external substrate defining a first pair of RF signal input/output transmission vias filled with the conductive material and an interior RF signal transmission line of the conductive material extending between and interconnecting the pair of RF signal input/output transmission vias and providing an indirect cross-coupling path for the transmission of a portion of an RF signal between one of the first plurality of resonators in the first block of dielectric material and one of the second plurality of resonators in the second block of dielectric material.

7. The waveguide filter of claim 6 wherein the pair of RF signal input/output transmission vias terminate in respective openings in opposed exterior surfaces of the substrate, the opposed exterior surfaces of the substrate being covered with a layer of the conductive material, the layer of the conductive material defining a ground layer and a pair of isolated RF signal input/output pads surrounding the openings defined in the opposed exterior surfaces of the substrate by the pair of RF input/output transmission vias.

8. The waveguide filter of claim 7 wherein the external substrate defines a second plurality of ground vias filled with the conductive material and terminating in respective second openings in the ground layer of the conductive material on the respective exterior surfaces of the substrate.

9. The waveguide filter of claim 8 wherein the external substrate is in the form of a bar that bridges two of the plurality of resonators and the internal layer of conductive material.

10. The waveguide filter of claim 8 wherein the external substrate is in the form of a base for the block of dielectric material.

11. The waveguide filter of claim 9 wherein the external substrate includes a region of dielectric material extending over one of the pair of isolated RF signal input/output pads and a portion of the ground layer of the conductive material for tuning the waveguide filter.

12. The waveguide filter of claim 10 further comprising a slot in the external substrate that provides access to the interior RF signal transmission line and allows for trimming the conductive material of the RF signal transmission line for tuning the waveguide filter.

13. An external substrate adapted to be coupled to an exterior surface of a wave guide filter including at least first and second blocks of dielectric material coupled together and separated by an interior layer of conductive material, the first and second blocks of dielectric material defining a plurality of resonators defining a direct RF signal transmission path for the transmission of an RF signal, the substrate defining a pair of RF signal input/output transmission vias filled with the conductive material and an interior RF signal transmission line of the conductive material extending between and interconnecting the pair of RF signal input/output transmission vias and providing an indirect cross-coupling path for the transmission of a portion of the RF signal between one of the resonators in the first block of dielectric material and one of the resonators in the second block of dielectric material.

14. The external substrate of claim 13 in the form of a bar that bridges the one of the resonators in the first block of dielectric material and the one of the resonators in the second block of dielectric material.

15. The external substrate of claim 13 in the form of a mounting base for the first and second blocks of dielectric material.

* * * * *